US009194014B2

(12) United States Patent
Smith

(10) Patent No.: US 9,194,014 B2
(45) Date of Patent: Nov. 24, 2015

(54) REINFORCED DISTRIBUTOR FOR POST-COMBUSTION LANCE

(75) Inventor: Todd G. Smith, Harmony, PA (US)

(73) Assignee: Berry Metal Company, Harmony, PA (US)

( * ) Notice: Subject to any disclaimer, the term of this patent is extended or adjusted under 35 U.S.C. 154(b) by 256 days.

(21) Appl. No.: 13/884,881

(22) PCT Filed: Nov. 10, 2011

(86) PCT No.: PCT/US2011/060255

§ 371 (c)(1),
(2), (4) Date: Sep. 13, 2013

(87) PCT Pub. No.: WO2012/064996

PCT Pub. Date: May 18, 2012

(65) Prior Publication Data

US 2013/0341841 A1 Dec. 26, 2013

Related U.S. Application Data

(60) Provisional application No. 61/412,348, filed on Nov. 10, 2010.

(51) Int. Cl.

| | |
|---|---|
| ***C21C 5/46*** | (2006.01) |
| ***F27D 3/16*** | (2006.01) |
| *C21C 5/30* | (2006.01) |

(52) U.S. Cl.
CPC ..... *C21C 5/4606* (2013.01); *F27D 3/16* (2013.01); *C21C 5/305* (2013.01); *F23C 2900/07021* (2013.01)

(58) Field of Classification Search
CPC ..... C21C 5/4606
USPC ..... 266/225, 265
See application file for complete search history.

(56) References Cited

U.S. PATENT DOCUMENTS

| | | | | |
|---|---|---|---|---|
| 2009/0189322 | A1* | 7/2009 | Strelbisky et al. | 266/44 |
| 2012/0211929 | A1* | 8/2012 | Strelbisky et al. | 266/265 |
| 2013/0341841 | A1* | 12/2013 | Smith | 266/225 |

* cited by examiner

*Primary Examiner* — Scott Kastler
(74) *Attorney, Agent, or Firm* — Paul D. Bangor, Jr.; Clark Hill, PLC

(57) ABSTRACT

A distributor for a post-combustion lance, comprising: an annular member, an inner reinforcing sleeve and an outer sleeve, wherein the inner reinforcing sleeve defines a plurality of first openings and the annular member defines a plurality of second openings, wherein each of the first and second openings is in fluid communication, directly or indirectly, with a first cooling fluid passageway of the lance. Each of the first openings may be contiguous with and in direct fluid communication with one of the second openings. Additionally, the annular member may define a plurality of third openings, wherein each of the third openings is in fluid communication with a second cooling fluid passageway of the lance.

15 Claims, 8 Drawing Sheets

REINFORCED DISTRIBUTOR FOR POST-COMBUSTION LANCE

CROSS REFERENCE TO RELATED APPLICATIONS

This application claims the benefit of the filing date of U.S. provisional patent application Ser. No. 61/412,348, entitled "Reinforced Distributor For Post-Combustion Lance," and filed on Nov. 10, 2010, the entirety of which is incorporated herein by reference for all purposes.

FIELD OF THE INVENTION

This invention is related to a composite, reinforced distributor assembly for a post-combustion lance.

BACKGROUND OF THE INVENTION

As shown in FIG. 1, metallurgical processes such as basic oxygen steelmaking often employ large (typically, about 8 inches to about 16 inches in diameter, approximately 65-85 feet long, and up to approximately 10 tons in weight) water-cooled oxygen lances 1 to efficiently remove oxidizable elements from molten metal 8 below slag 7 in a metallurgical converter such as a basic oxygen furnace 6. Typically, in addition to the primary oxygen ports 2 at the tip 3 of the lance 1, the prior art oxygen lance 1 may include a ring 4 of small oxygen ports 5 located on the outside of the lance 1 a distance up the lance 1 from the primary oxygen tip 3. These lances 1 are known as post-combustion lances. The ring 4 of small ports 5 distributes oxygen to the furnace atmosphere to react with gases from the process and is known as a post-combustion (or "PC") distributor.

Due to heat transfer requirements, and also to protect the PC distributor from the furnace atmosphere and the localized heat generated from the post-combustion reaction, the PC distributor (and often, the piping associated therewith) is made of high thermal conductivity metals such as high purity copper.

Although the post-combustion lance often is used to direct oxygen into a metallurgical converter, various other gases may be directed through the lance, depending on the reactions desired. Any and all reaction gases directed through the lance are generally referred to hereinafter as a "gas" for convenience, it being understood that the gas may be oxygen or any other reactive or non-reactive gas or gases. Typically, the gas is injected through the lance at very high rates. For example, oxygen may be injected into the lance at rates of between 300 cubic meters/min. and 600 cubic meters/min.

As is well known in the art, lances are subjected to bending stresses during their service lives, particularly during loading and unloading operations and during lance deskulling operations when the lance is typically placed horizontally on the service floor. During movement of the lance, whether for installation or deskulling, the lance typically is lifted only at the upper end (i.e., above the distributor) with the tip at the lower end resting on the floor at some point during such movements. Accordingly, the prior art lance typically is subject to deflection (i.e., substantially or at least partially transverse deflection) due to the bending loads to which it is subjected.

The maintenance interval for a lance is normally driven by lance tip life, with the lance body lasting many times the life of the tip. Lances equipped with the PC distributor typically are prone to severe bending (i.e., permanent deflection) and, in some cases, failure at the PC distributor, because of the relatively low yield strength of the high thermal conductivity components in the PC distributor. Since the introduction of the mid-lance PC distributor (i.e., at least in the 1980s, and possibly earlier), no effective solutions to the bending and/or failure problems have been implemented. Prior art post-combustion lances typically bend after a relatively short period in service, requiring relatively frequent replacement of the PC distributor.

Previous attempts to address this problem included the development of external removable protective sleeves which are put on new and refurbished PC distributor equipped lances to protect the lances during shipping to the user's facilities. However, the protective sleeves must be removed before the lance is put into service. In practice, sleeves are typically removed prior to completion of the unloading and installation of the lance. As a result, the lance is often bent subsequent to the protective sleeve removal, i.e., during the completion of installation, while in service, or while the lance is loaded back onto the truck for return and repair at the end of its maintenance interval.

Other attempts to address these problems included the use of an internal reinforcing tube disposed within the main gas passageway with apertured support collars that allow gas flow through the collars, wherein the internal reinforcing tube is not part of the PC distributor but extends within the main gas passageway upstream and downstream of the PC distributor.

BRIEF SUMMARY OF THE INVENTION

In a first aspect, the present invention comprises a distributor for a post-combustion lance, comprising: an annular member, an inner reinforcing sleeve and an outer sleeve. In this first aspect, the annular member and the inner reinforcing sleeve may be made from different materials and the annular member and the outer sleeve each may be made from a first material. Further, the annular member and the outer sleeve each may be made from a first material and the inner reinforcing sleeve may be made from a second material.

In another aspect of the distributor for a post-combustion lance of the present invention, a plurality of longitudinal ribs are spaced around an inner surface of the inner reinforcing sleeve and/or one or more of the plurality of longitudinal ribs is made of steel or other high strength material. Further, a plurality of longitudinal ribs may be spaced around an inner surface of the outer sleeve and may be made from steel or other high strength material.

In yet a further aspect of the distributor for a post-combustion lance of the present invention, the annular member may define a plurality of openings that permit gas flow from within a gas passageway of the lance to flow through the annular member and outside of the lance and the inner reinforcing sleeve may define a plurality of first openings and the annular member may define a plurality of second openings, wherein each of the first and second openings are in fluid communication, directly or indirectly, with a first cooling fluid passageway of the lance. Further, each of the first openings is contiguous with and in direct fluid communication with one of the second openings. Additionally, the annular member may define a plurality of third openings, wherein each of the third openings is in fluid communication with a second cooling fluid passageway of the lance.

In yet an additional aspect of the distributor for a post-combustion lance of the present invention, the annular member and the outer sleeve are each made from copper and the inner reinforcing sleeve is made from steel.

In yet another aspect of the distributor for a post-combustion lance of the present invention, the annular member and the outer sleeve are each made from one or more materials of high thermal conductivity and/or high oxidation resistance, and wherein the inner reinforcing sleeve is made from a high strength material. Further, a plurality of first longitudinal ribs are spaced around an inner surface of the inner reinforcing sleeve and a plurality of second longitudinal ribs are spaced around an inner surface of the outer sleeve, and wherein one or more of the first and second longitudinal ribs is made of steel or other high strength material.

BRIEF DESCRIPTION OF THE SEVERAL VIEWS OF THE DRAWINGS

For the present disclosure to be easily understood and readily practiced, the present disclosure will now be described for purposes of illustration and not limitation in connection with the following figures, wherein.

DETAILED DESCRIPTION OF PREFERRED EMBODIMENT(S) OF THE INVENTION

In the following detailed description, reference is made to the accompanying examples and figures that form a part hereof, and in which is shown, by way of illustration, specific embodiments in which the inventive subject matter may be practiced. These embodiments are described in sufficient detail to enable those skilled in the art to practice them, and it is to be understood that other embodiments may be utilized and that structural or logical changes may be made without departing from the scope of the inventive subject matter. Such embodiments of the inventive subject matter may be referred to, individually and/or collectively, herein by the term "invention" merely for convenience and without intending to voluntarily limit the scope of this application to any single invention or inventive concept if more than one is in fact disclosed.

The following description is, therefore, not to be taken in a limited sense, and the scope of the inventive subject matter is defined by the appended claims and their equivalents.

Figure 1:
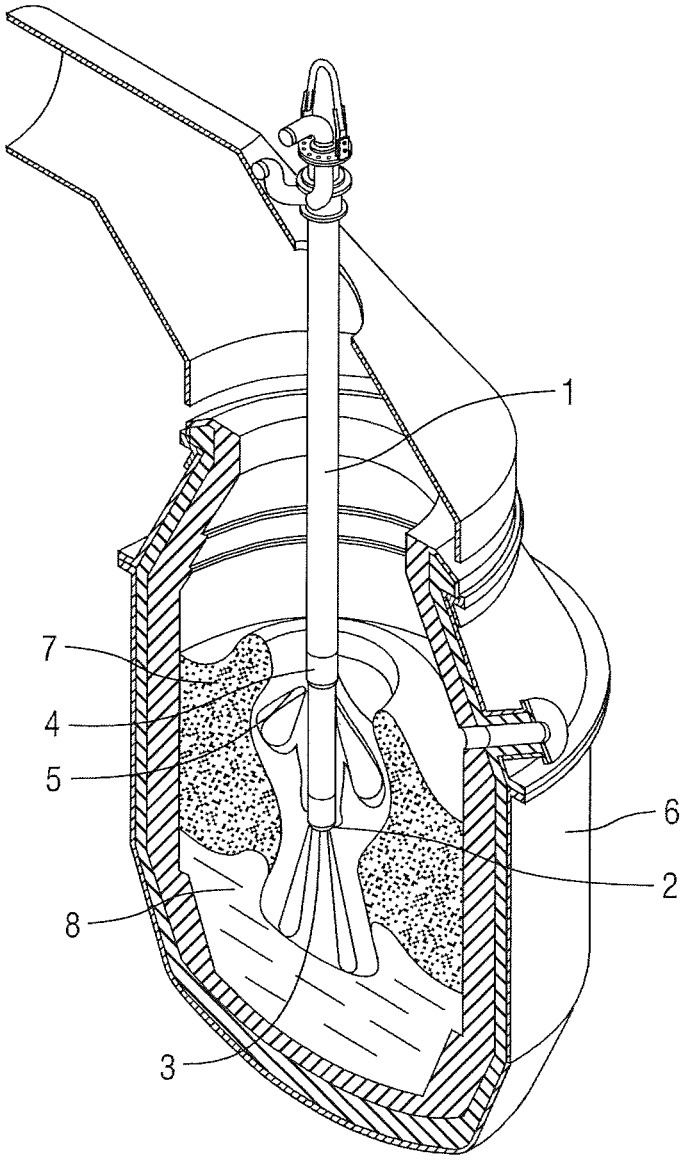
FIG. 1 is a perspective, cut-away view showing a typical operation of a post-combustion lance in a basic oxygen furnace to make steel.
Figure 2:
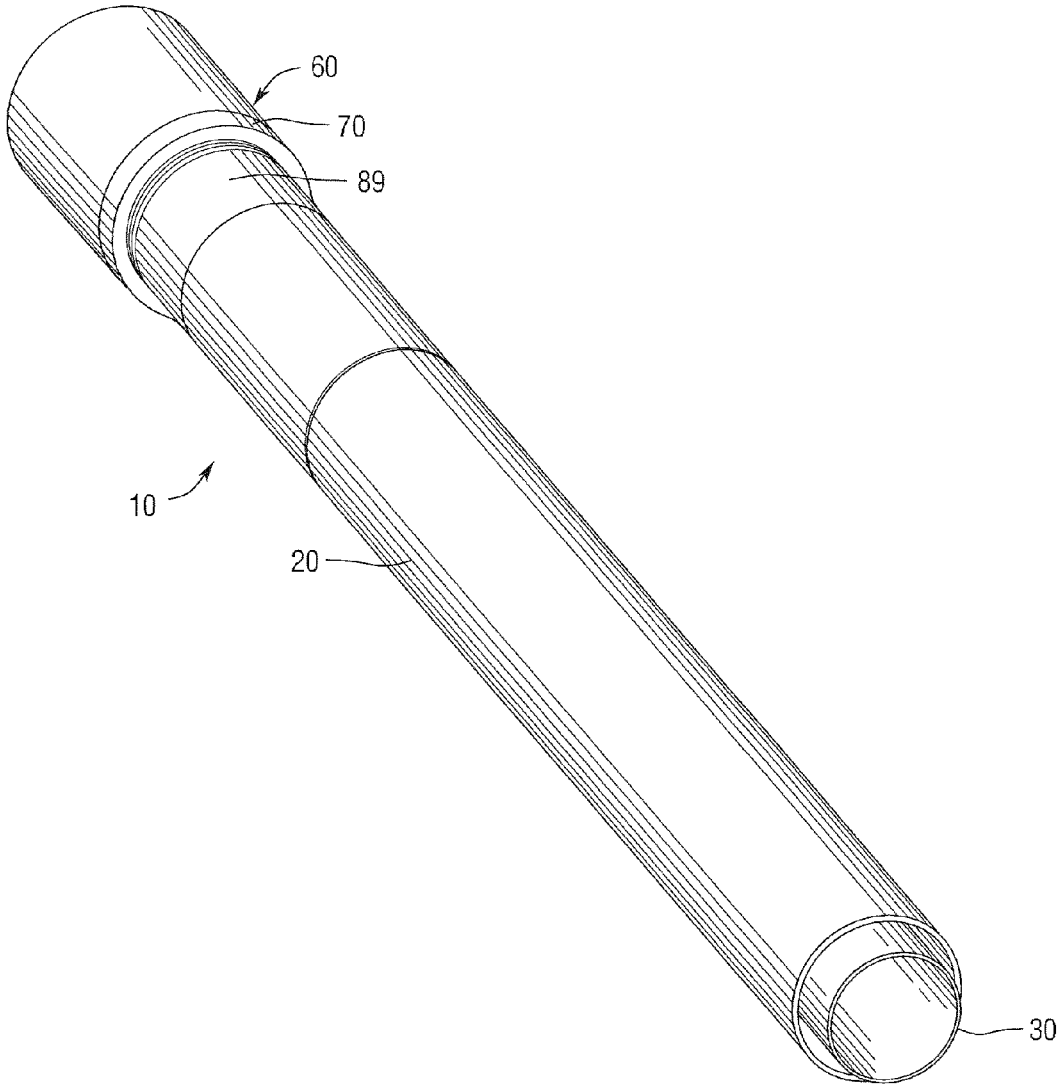
FIG. 2 is a perspective view of a composite, reinforced distributor assembly according to a preferred embodiment of the present invention for a post-combustion lance.
Figure 3:
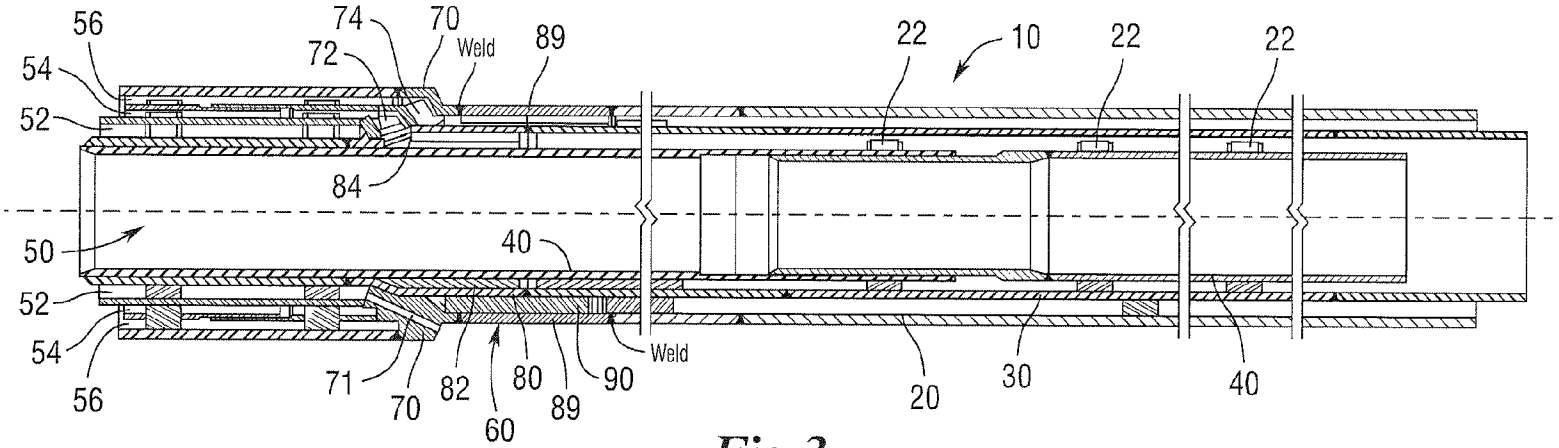
FIG. 3 is a longitudinal cross-sectional view of a composite, reinforced distributor assembly according to a preferred embodiment of the present invention for a post-combustion lance.
Figure 4:
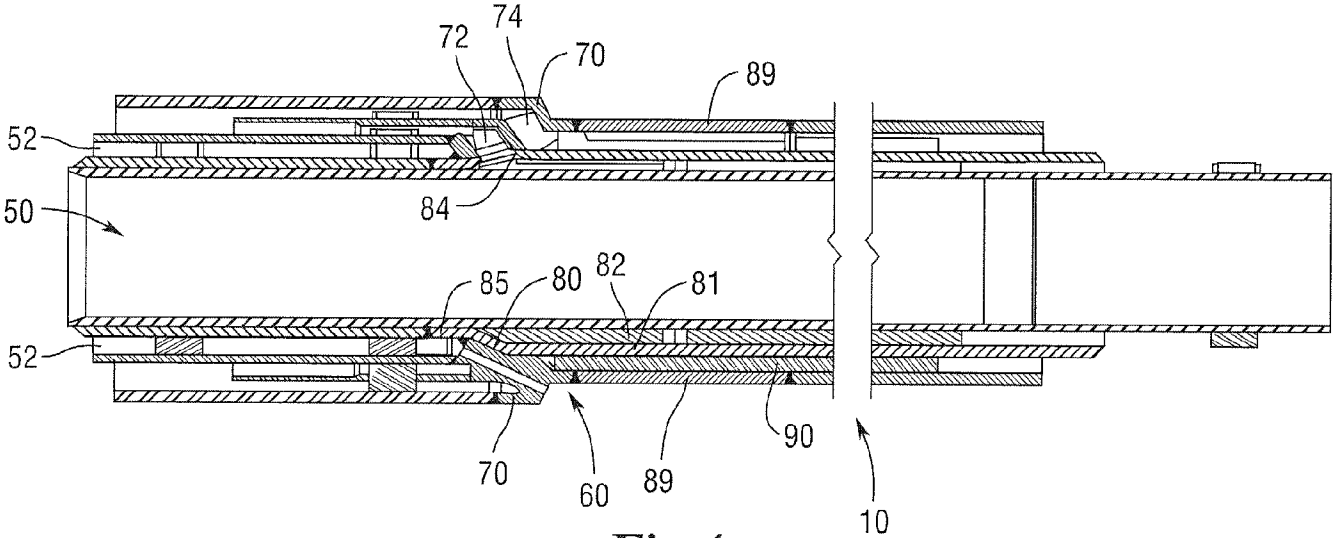
FIG. 4 is a longitudinal cross-sectional view of a composite, reinforced distributor assembly according to a preferred embodiment of the present invention for a post-combustion lance.
Figure 5:
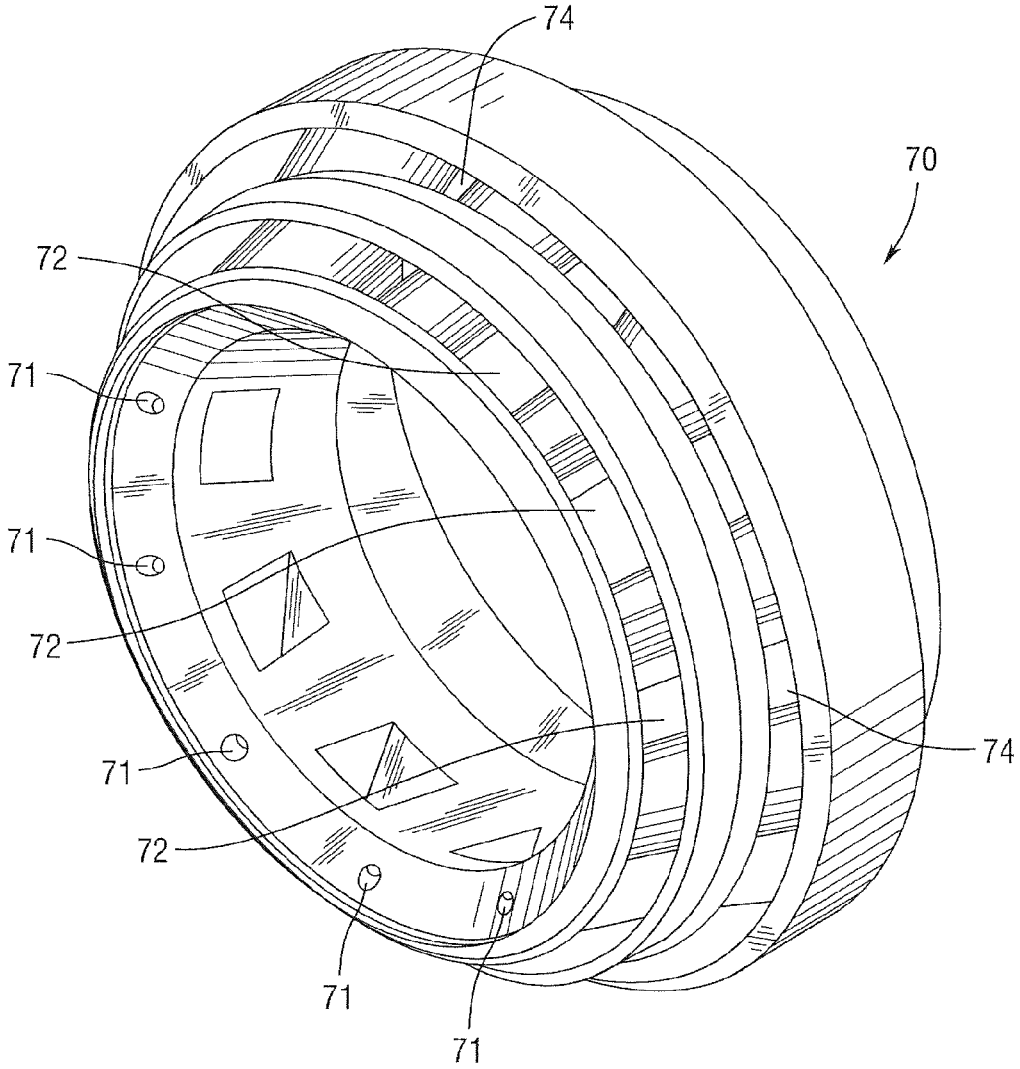
FIG. 5 is a perspective view of an annular member component of a composite, reinforced distributor assembly according to a preferred embodiment of the present invention for a post-combustion lance.
Figure 6:
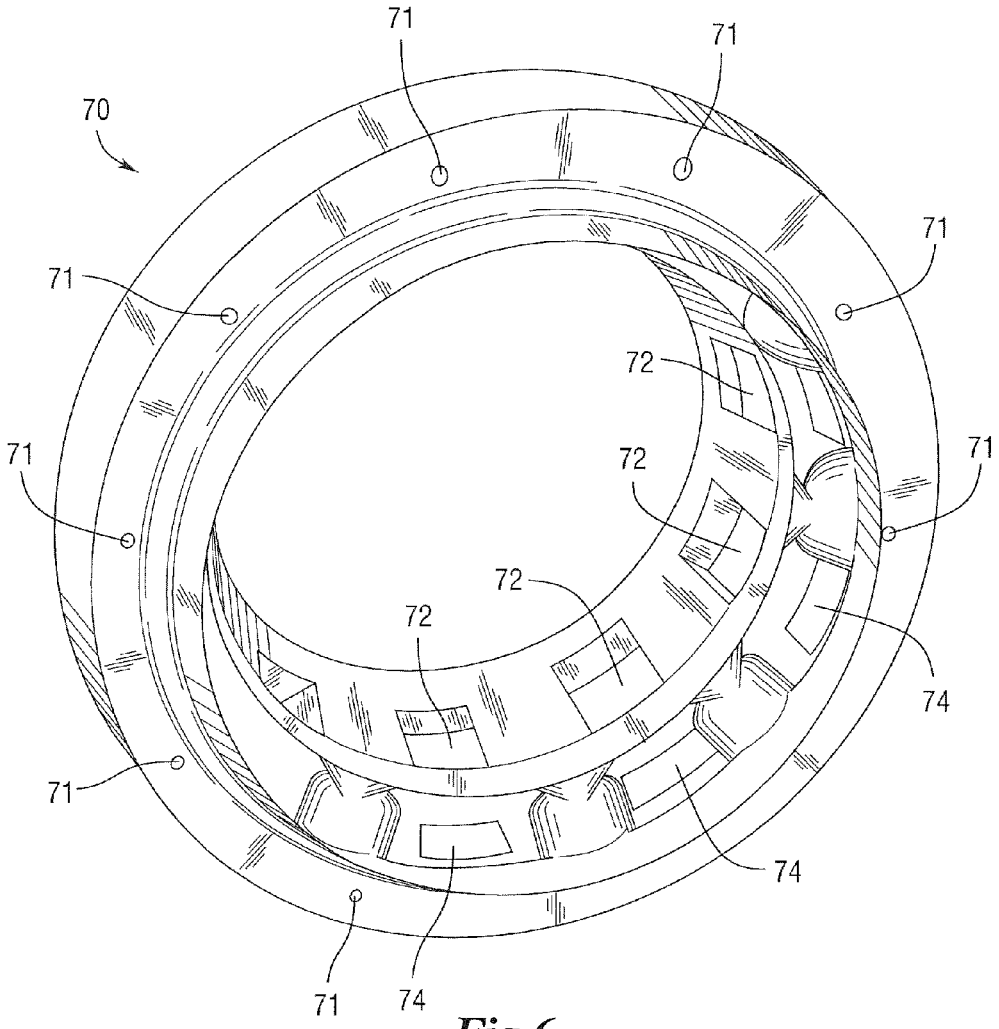
FIG. 6 is another perspective view of an annular member component of a composite, reinforced distributor assembly according to a preferred embodiment of the present invention for a post-combustion lance.
Figure 7:
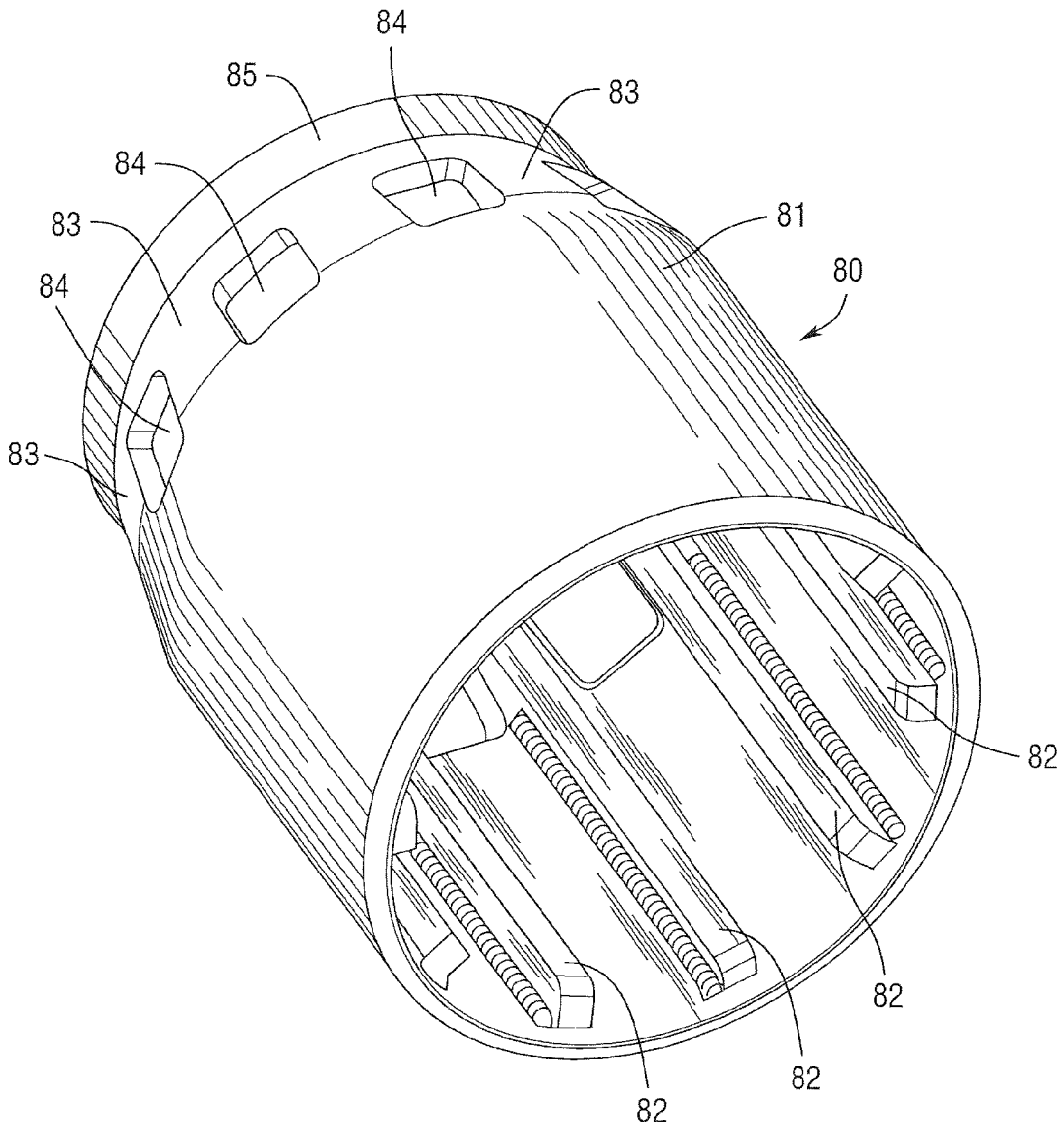
FIG. 7 is a perspective view of a reinforcing sleeve component of a composite, reinforced distributor assembly according to a preferred embodiment of the present invention for a post-combustion lance.
Figure 8:
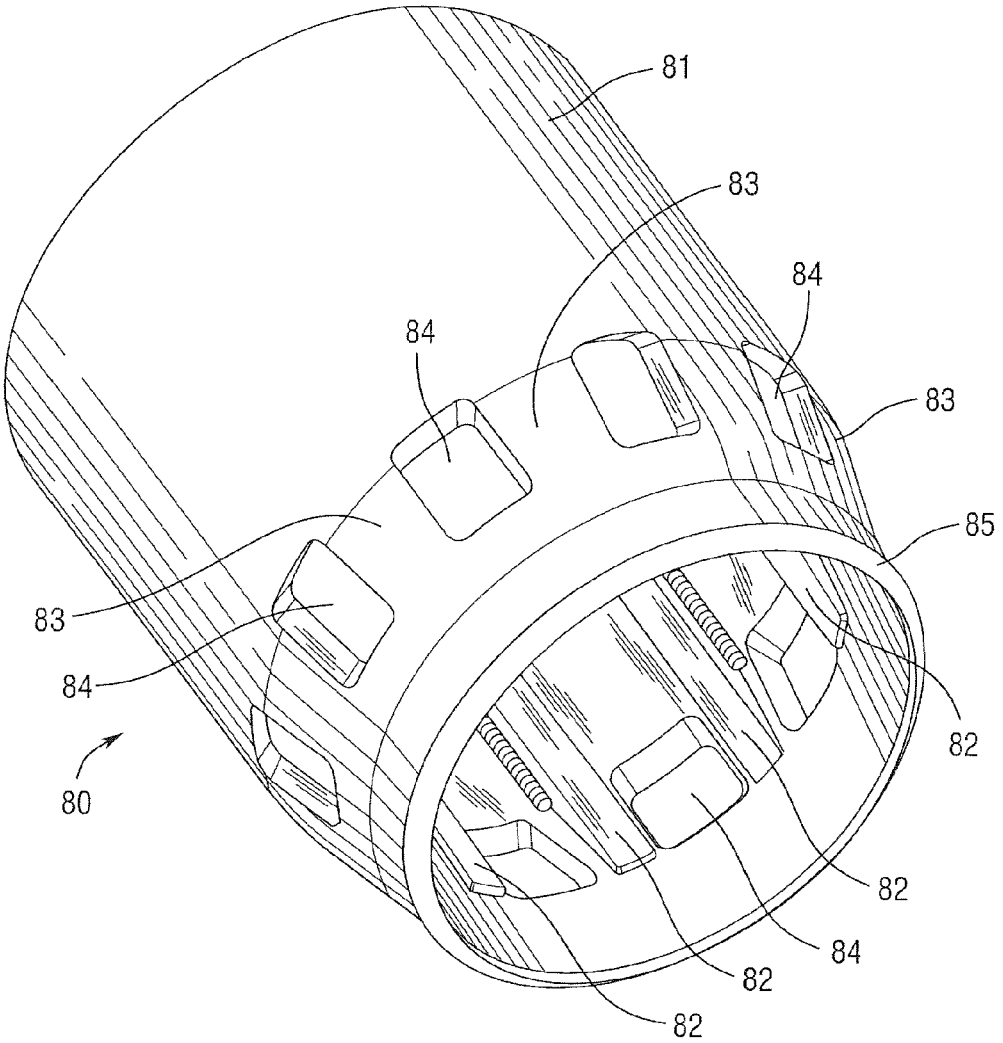
FIG. 8 is another perspective view of a reinforcing sleeve component of a composite, reinforced distributor assembly according to a preferred embodiment of the present invention for a post-combustion lance.
Figure 9:
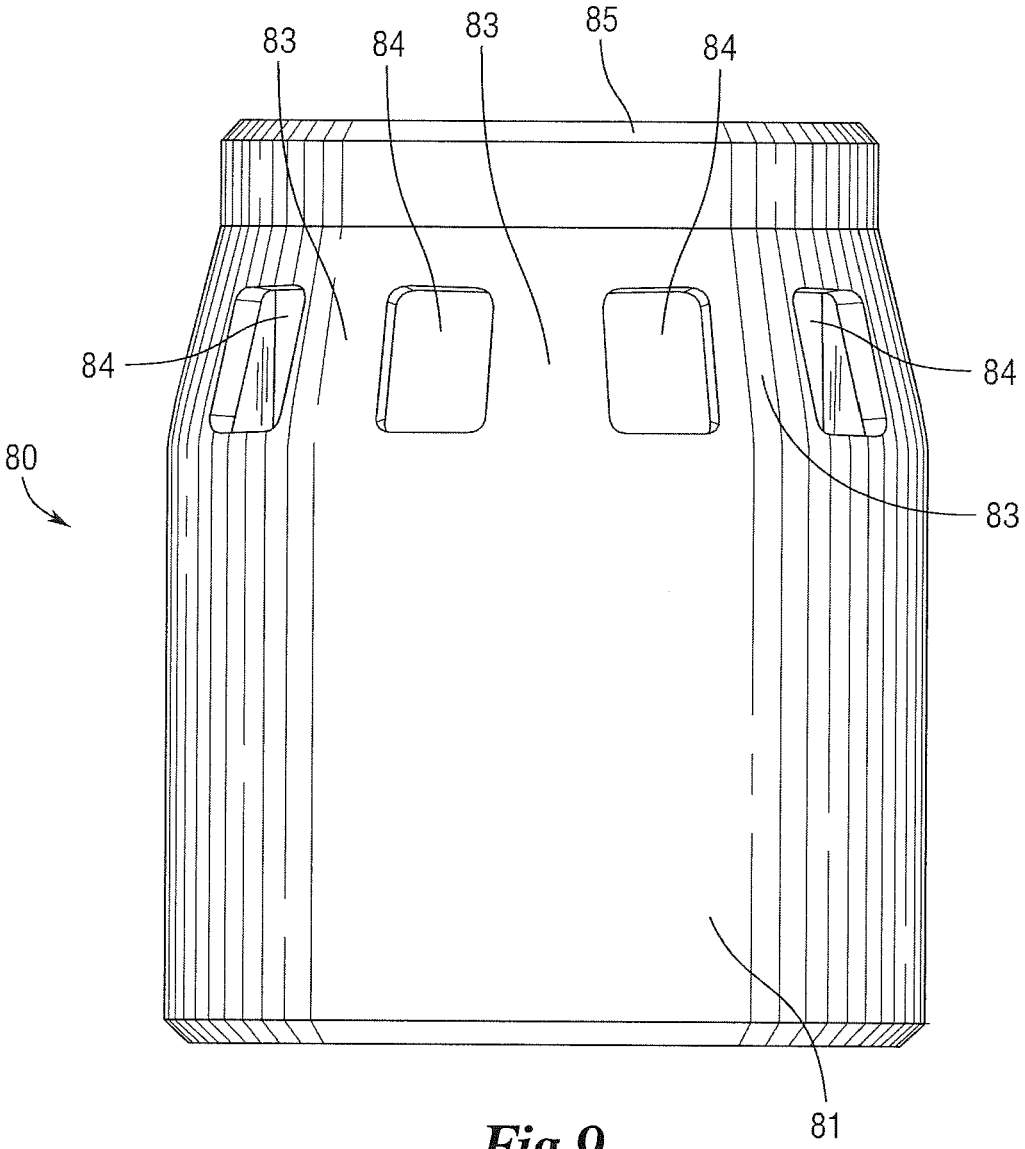
FIG. 9 is a side elevational view of a reinforcing sleeve component of a composite, reinforced distributor assembly according to a preferred embodiment of the present invention for a post-combustion lance.

The present invention is directed to composite, reinforced distributor assembly 60 of the present invention for use with a post combustion lance 10 comprising an outside tube 20, an intermediate tube 30 and an inside tube 40, the inside of the latter defining the main oxygen passageway 50. Spacers 22 are preferably disposed as required between tubes 20, 30 and 40 as shown in FIG. 3. The composite, reinforced distributor assembly 60 of the present invention comprises an annular member 70, preferably made of a copper casting or forging, an inner reinforcing sleeve 80, preferably of machined or formed steel and an outer heat conducting and oxidation resistant sleeve 89, preferably made of copper. Sleeves 80 and 89 are preferably welded to annular member 70 to form the distributor assembly 60, although other known means of attaching the three components 70, 80 and 89, such as brazing and other chemical or mechanical attachment means are within the scope of this invention. Reinforcing and spacing ribs 90, made of steel or copper, are preferably disposed around the inside annular surface of outer heat conducting sleeve 89 contiguous with inner reinforcing sleeve 80.

As shown in the drawings, reinforcing sleeve 80 preferably comprises a main body section 81, an intermediate annular slanted section 83 and an annular open end portion 85. Further, the inside of reinforcing sleeve 80 preferably has disposed thereon elongated reinforcement ribs 82, preferably made of steel or other high strength material, that provide additional reinforcement to the distributor assembly 60 and also act to evenly space the distributor assembly 60 with respect to the inside tube 40. Ribs 82 may be integrally formed with sleeve 80 or attached thereto by welding or other known means.

Annular member 70 defines post combustion oxygen ports 71 in fluid communication with secondary oxygen passageway 52. Reinforcing sleeve 80 further defines cooling fluid openings 84 that allow the flow of cooling fluid through inlet cooling fluid passageway 54 via such openings 84.

As shown in the figures, openings 84 of sleeve 80 match up with openings 72 defined by annular member 70 in the assembled distributor 60. Annular member 70 also defines openings 74 which are in fluid communication with return cooling fluid passageway 56. In such manner, the distributor assembly 60 with reinforcing sleeve 80 provides reinforcement strength for the post combustion lance 10 while still allowing inlet and return cooling fluid to flow through distributor 60.

In the foregoing Detailed Description, various features are grouped together in a single embodiment to streamline the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A distributor for a post-combustion lance, comprising:

an annular member, an inner reinforcing sleeve and an outer sleeve;

wherein the inner reinforcing sleeve defines a plurality of first openings and the annular member defines a plurality of second openings, wherein each of the first and second openings is in fluid communication, directly or indirectly, with a first cooling fluid passageway of the lance.

2. The distributor for a post-combustion lance of claim 1 wherein the annular member and the inner reinforcing sleeve are made from different materials.

3. The distributor for a post-combustion lance of claim 1 wherein the annular member and the outer sleeve are each made from a same first material.

4. The distributor for a post-combustion lance of claim 1 wherein the annular member and the outer sleeve are each made from a first material and the inner reinforcing sleeve is made from a second material.

5. The distributor for a post-combustion lance of claim 1 wherein a plurality of longitudinal ribs are spaced around an inner surface of the inner reinforcing sleeve.

6. The distributor for a post-combustion lance of claim 5 wherein one or more of the plurality of longitudinal ribs is made of steel.

7. The distributor for a post-combustion lance of claim 1 wherein a plurality of longitudinal ribs are spaced around an inner surface of the outer sleeve.

8. The distributor for a post-combustion lance of claim 7 wherein one or more of the plurality of longitudinal ribs is made of steel.

9. The distributor for a post-combustion lance of claim 1 wherein the annular member defines a plurality of openings that permit gas flow from within a gas passageway of the lance to flow through the annular member and outside of the lance.

10. The distributor for a post-combustion lance of claim 1 wherein each of the first openings is contiguous with and in direct fluid communication with one of the second openings.

11. The distributor for a post-combustion lance of claim 10 wherein the annular member defines a plurality of third openings, wherein each of the third openings is in fluid communication with a second cooling fluid passageway of the lance.

12. The distributor for a post-combustion lance of claim 1 wherein the annular member and the outer sleeve are each made from copper and the inner reinforcing sleeve is made from steel.

13. The distributor for a post-combustion lance of claim 12 wherein a plurality of first longitudinal ribs are spaced around an inner surface of the inner reinforcing sleeve and a plurality of second longitudinal ribs are spaced around an inner surface of the outer sleeve; and wherein one or more of the first and second longitudinal ribs is made of steel.

14. The distributor for a post-combustion lance of claim 1 wherein a plurality of first longitudinal ribs are spaced around an inner surface of the inner reinforcing sleeve and a plurality of second longitudinal ribs are spaced around an inner surface of the outer sleeve.

15. The distributor for a post-combustion lance of claim 14 wherein one or more of the first and second longitudinal ribs is made of steel.

* * * * *